US010343828B2

(12) United States Patent
Shaw

(10) Patent No.: US 10,343,828 B2
(45) Date of Patent: Jul. 9, 2019

(54) TAMPER-EVIDENT FORENSIC DOCUMENT MAILER WITH DUAL SIDED ACCESS TO INTERIOR COMPARTMENT FOR RECEIPT AND SUBSEQUENT RETURN OF SECURE EVIDENCE AND SUPPORTING LEGAL DOCUMENTS

(71) Applicant: Raymond R. Shaw, Farmington Hills, MI (US)

(72) Inventor: Raymond R. Shaw, Farmington Hills, MI (US)

( * ) Notice: Subject to any disclaimer, the term of this patent is extended or adjusted under 35 U.S.C. 154(b) by 0 days.

(21) Appl. No.: 15/834,357

(22) Filed: Dec. 7, 2017

(65) Prior Publication Data

US 2019/0177061 A1 Jun. 13, 2019

(51) Int. Cl.
*B65D 55/06* (2006.01)
*B65D 43/16* (2006.01)
*B65D 65/40* (2006.01)

(52) U.S. Cl.
CPC ..... *B65D 55/06* (2013.01); *B65D 43/162* (2013.01); *B65D 65/403* (2013.01)

(58) Field of Classification Search
CPC .. A44B 18/0084; B29C 43/222; B65D 81/00; B65D 2313/02; B65D 2313/08; B65D 27/00; B65D 27/06; B65D 27/08; B65D 33/16; B65D 33/18; B65D 33/24; B65D 5/42; B65D 5/4204; B65D 33/1691; B65D 33/34
See application file for complete search history.

(56) References Cited

U.S. PATENT DOCUMENTS 3,640,447 A * 2/1972 Forbes, Jr. ..... B65D 5/603 206/216
3,669,345 A * 6/1972 Cole ..... B65D 5/5425 229/101.2
3,711,012 A * 1/1973 Cytron ..... B42D 15/08 229/306
3,768,719 A * 10/1973 Johnson ..... B65D 5/5405 229/117.3
4,285,150 A * 8/1981 Richardson ..... B65D 5/4266 229/150

(Continued)

FOREIGN PATENT DOCUMENTS

FR 1327709 A 5/1963
GB 2514101 B 5/2017
WO 2004014751 A2 2/2004

*Primary Examiner* — Brian D Nash
(74) *Attorney, Agent, or Firm* — Dinsmore & Shohl LLP

(57) ABSTRACT

A secure mailer including a rigid three dimensional body having a lid hingedly attached thereto. A surface of the body exhibiting a breakaway panel for gaining access to an interior enclosure. A plurality peel away strips reveal adhesives supported upon an inside surface of the lid and, upon pre-depositing a first item within the enclosure, for sealing the lid against the body in tamper evident and closing fashion. A plurality of tear-away strips extend in inwardly and perimeter extending fashion relative to the adhesives, the strips being accessible from an exterior of the lid and along three sides interconnecting with a fourth hinged side. In this manner, removal of the strips causes detachment of an inner remaining area of the lid from the adhesives for re-accessing the interior enclosure.

7 Claims, 7 Drawing Sheets

(56) References Cited

U.S. PATENT DOCUMENTS 4,306,367 A * 12/1981 Otto ..... B65D 5/4229 206/831
4,333,602 A * 6/1982 Geschwender ..... B65D 5/6611 229/125.39
4,358,494 A * 11/1982 Akimoto ..... B32B 27/10 428/41.3
4,411,365 A * 10/1983 Horikawa ..... B65D 5/5435 229/117.31
4,700,831 A * 10/1987 Kassai ..... B65D 5/4204 206/232
5,104,124 A * 4/1992 Bernard ..... A63F 9/001 273/119 R
5,265,799 A * 11/1993 Stone ..... B65D 5/543 229/122.33
5,363,981 A * 11/1994 Giblin ..... B65D 5/0281 229/160.1
5,415,282 A * 5/1995 Kienholz ..... A01N 1/02 206/216
5,503,328 A * 4/1996 Roccaforte ..... B65D 27/06 229/301
6,045,037 A * 4/2000 McGeehin ..... B65D 5/0227 229/125.39
6,413,605 B1 * 7/2002 Hoffer ..... B65D 55/026 283/101
7,407,087 B2 * 8/2008 DeBusk ..... B65D 5/0005 229/101.1
7,959,060 B2 * 6/2011 Wilson ..... B65D 5/0005 229/101.2
8,915,420 B2 * 12/2014 Masague ..... B65D 5/10 220/254.6
9,346,582 B2 * 5/2016 Pinkstone ..... B65D 5/5415
9,550,616 B2 * 1/2017 Hallak ..... B65D 75/5855
9,604,753 B2 * 3/2017 Krause ..... B65D 5/56
10,053,274 B1 * 8/2018 O'Neill ..... B65D 79/00
10,099,807 B2 * 10/2018 Eisen ..... B65B 11/004
2003/0031386 A1 2/2003 Shepard et al.
2003/0111523 A1 * 6/2003 Haugan ..... B65D 5/248 229/125.19
2006/0013512 A1 * 1/2006 Shaw ..... B65D 33/1691 383/5
2006/0072855 A1 * 4/2006 Shaw ..... B65D 33/1691 383/5
2009/0196532 A1 * 8/2009 Shaw ..... B65D 75/14 383/5
2011/0210031 A1 * 9/2011 Shaw ..... B65D 5/4204 206/459.5
2013/0139311 A1 * 6/2013 Shaw ..... A47K 11/02 4/479
2013/0262333 A1 10/2013 Wicker et al.
2016/0255954 A1 * 9/2016 Shaw ..... A47B 61/06
2016/0257443 A1 * 9/2016 Shaw ..... B65D 5/2052
2016/0304234 A1 * 10/2016 Herkenrath ..... B65D 5/54
2016/0304235 A1 * 10/2016 Herkenrath ..... B65D 5/54
2017/0297802 A1 * 10/2017 Davis ..... B65D 43/16
2018/0072086 A1 * 3/2018 Mayer ..... B42D 15/022

* cited by examiner

TAMPER-EVIDENT FORENSIC DOCUMENT MAILER WITH DUAL SIDED ACCESS TO INTERIOR COMPARTMENT FOR RECEIPT AND SUBSEQUENT RETURN OF SECURE EVIDENCE AND SUPPORTING LEGAL DOCUMENTS

BACKGROUND OF THE INVENTION

Field of the Invention

The present invention relates generally to a forensic document mailer. More specifically, the present invention discloses a tamper evident and durable mailer having first and second reverse-sided access capability to an interior compartment associated with the mailer. One application can include a party sending evidentiary items or the like using a first access side and outgoing mailing label, with associated legal documentation being return sent by the original addressee/subsequent addressor using the first access side, such as along with a return mailing label.

Description of the Background Art

The prior art is documented with various examples of tamper evident and authenticating document delivery structures.

A first example of this is depicted in WO 2004/014751 which teaches a reclosable mailer including a body having first and second opposing side walls. Edges of the side walls are joined to form therebetween a pouch having an open end. The first and second opposing side walls have a width and length sufficient to allow the pouch to accommodate an unfolded 8×11 inch piece of paper, and an outer surface of at least one of the side walls includes an area markable with ink for identifying an intended recipient of the mailer.

The mailer includes a closure that has first and second fastener strips. The first fastener strip includes a strip form base that has an array of discrete first fastener elements integrally molded with and extending from the base. The second fastener strip includes a plurality of second fastener elements engageable by the first fastener elements. The fastener strips are permanently attached to the body and positioned to releasably engage one another to close the open end of the pouch.

A further example drawn from the prior art is the reclosable bag structure of Shepard US 2003/0031386 which teaches a reclosable bag which has a closure including first and second fastener strips. The first fastener strip includes a strip form base having an array of discrete hook fastener elements integrally molded with and extending from the base. The second fastener strip includes loop elements engageable by the hook fastener elements. The polyethylene bases of the fastener strips are welded directly to the body of the mailer, which is formed of a coextrusion of polyethylene materials. One of the fastener strips is unattached to the bag body along most of its length, so as to avoid undesired opening by shifting of bag contents for use of the bag as an interoffice mailing envelope.

SUMMARY OF THE PRESENT INVENTION

The present invention discloses a secure mailer including a rigid three dimensional body having a lid hingedly attached thereto. A surface of the body exhibiting a breakaway panel for gaining access to an interior enclosure. A plurality peel away strips reveal adhesives supported upon an inside surface of the lid and, upon pre-depositing a first item within the enclosure, for sealing the lid against the body in tamper evident and closing fashion. A plurality of tear-away strips extend in inwardly and perimeter extending fashion relative to the adhesives, the strips being accessible from an exterior of the lid and along three sides interconnecting with a fourth hinged side. In this manner, removal of the strips causes detachment of an inner remaining area of the lid from the adhesives for re-accessing the interior enclosure.

Additional features include a second plurality of peel away strips supported upon the surface of the body surrounding a perimeter defining the breakaway panel, removal of the second strips permitting tamper evident reclosing of the inner remaining area of the lid. The breakaway panel may further include first and second panels arranged on opposite surfaces of the body, with the lid further including first and second lids hingedly attached to the body in overlaying fashion relative to the panels.

Yet additional features include the body being constructed of a rigid corrugated paperboard material. The body can be utilized in a first stage for secure and tamper-evident storage and transport of an item of evidence, and subsequently utilized in a second succeeding stage for removal of the evidence and replacement with an associated documentation for secure and tamper-evident storage and transport of the documentation.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 4:
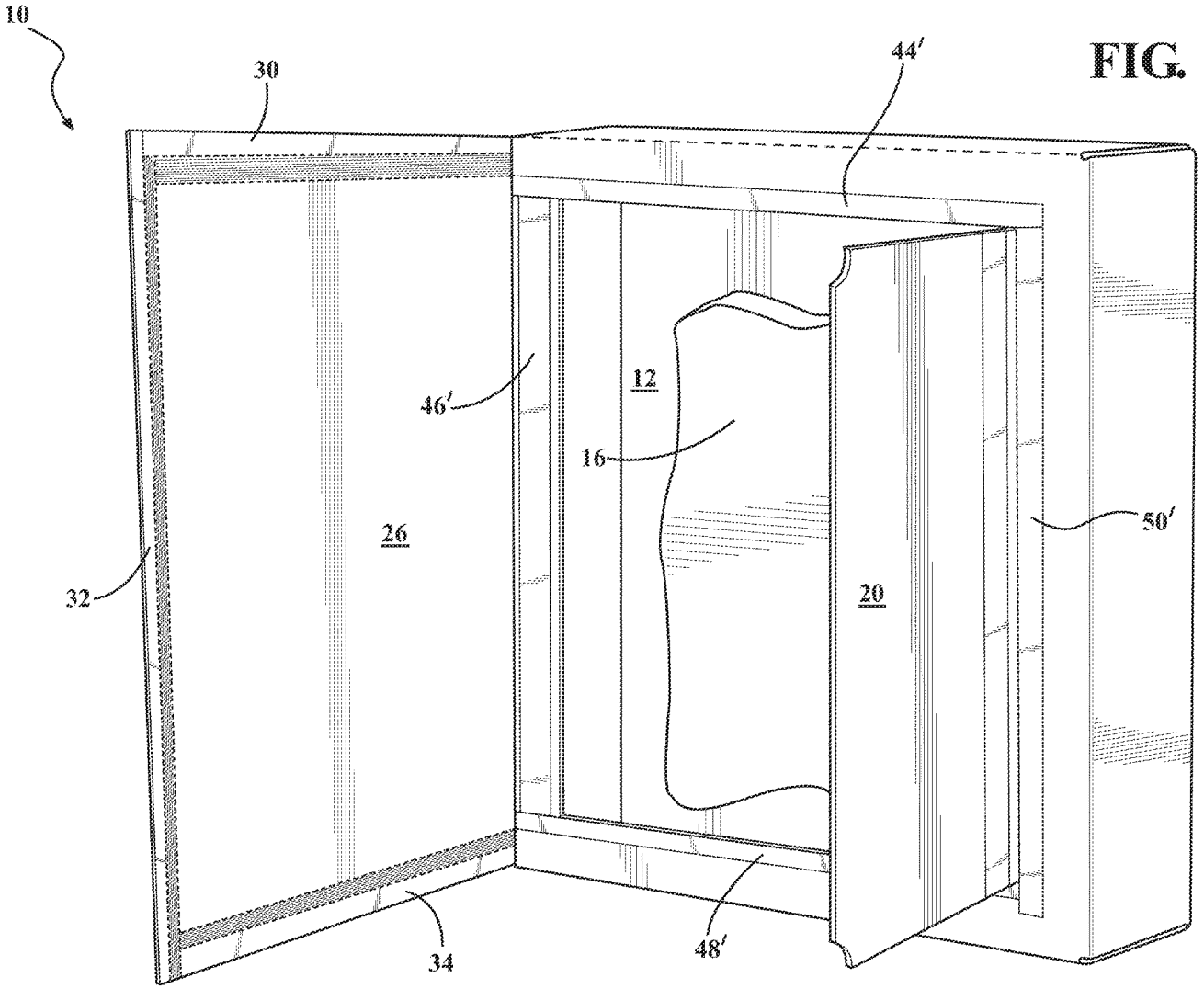
FIG. 4 is a subsequent illustration of the removability of the panel in FIGS. 2-3 (or of a reverse facing second panel), for revealing the common interior compartment, and in which can be deposited such as an evidentiary item prior to resealing and, upon removing the first outer perimeter tamper evident adhesives for securing the lid, for mailing to a desired recipient/addressee in tamper evident fashion.
Figure 5:
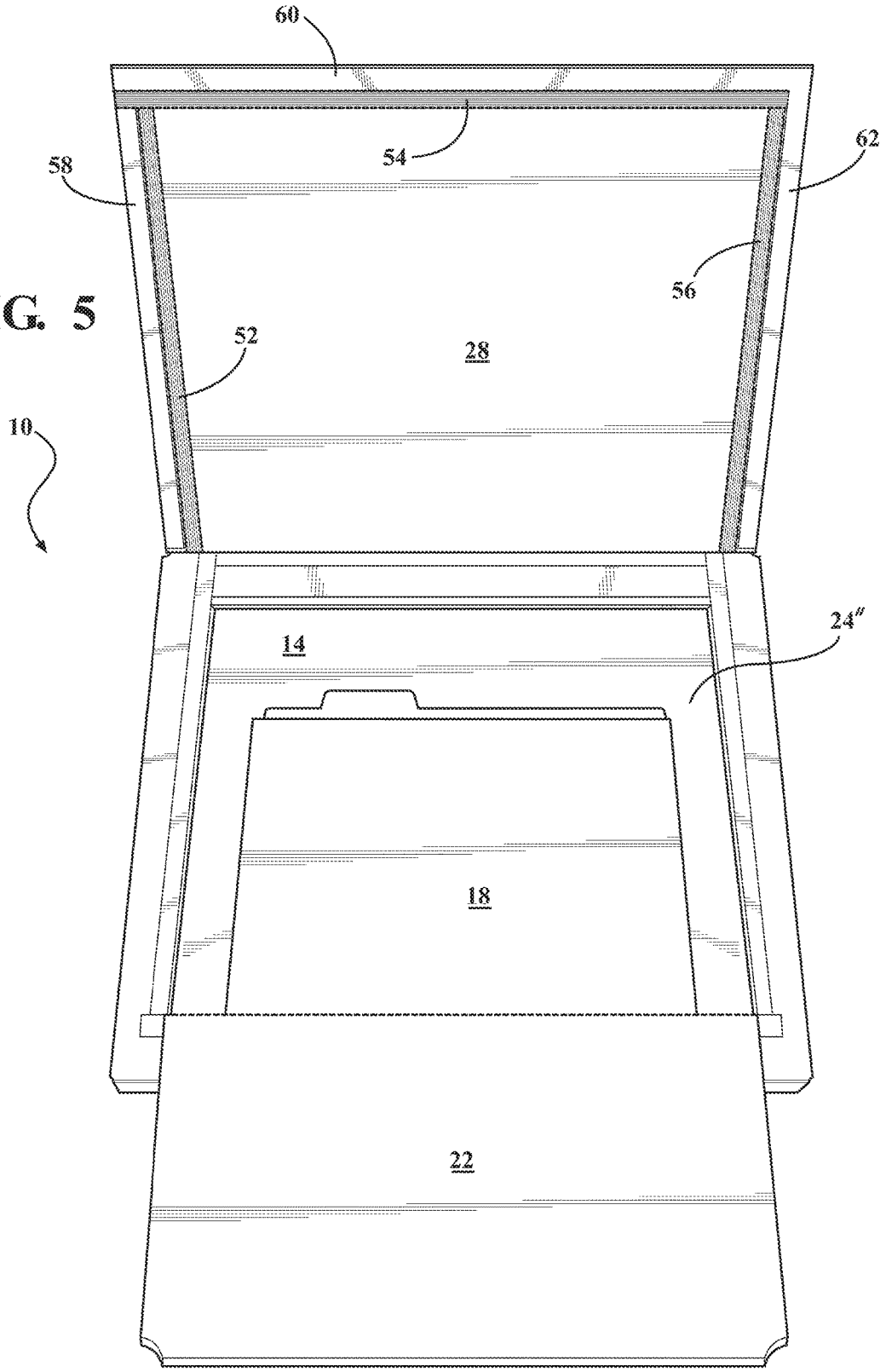
FIG. 5 is an illustration of a reverse or second side access to the interior compartment and showing the ability, similarly configured to the first side, and providing the ability to return mail legal documentation in likewise tamper-evident fashion.

With reference to the attached illustrations, the present invention relates generally to a forensic document mailer. More specifically, the present invention discloses a tamper evident and durable mailer, see generally at 10 having a main body with an interior compartment accessible in a first condition 12 (FIG. 4) and second reverse-sided condition 14 (FIG. 5), such enabling dual stage use in the sending of such as items of evidence in a first secure and tamper evident stage, following which the first item is removed, a second item replaced (such as which without limitation can include any documentation relative to the evidence which may need to be sent in secure and tamper evident fashion between parties (e.g. law enforcement, prosecutor's office, etc.,). In this fashion, the dual use and tamper evident access/reclosing capabilities provided by the forensic document mailer provide for evidentiary secure mailing (or personal and supervised transport) of the evidence items in a manner which avoids arguments as to tainting of the evidence or the chain of possession when such is involved in criminal matters.

As will be further described, one non-limiting application can include a party sending such evidentiary items or the like (see at 16 in FIG. 4) using the compartment configured as at 12, with associated legal documentation (further at 18 in FIG. 5), this being received by an original addressee/subsequent addressor in the second reconfigured (reverse sided) condition 14, in which a secondary evidentiary item (e.g. documentation 18) is substituted along with a return mailing label (not shown). The ability to both close/send and reopen/receive and reclose/resend either of the evidence item 16 or documentation 18 in tamper evident fashion is made possible by the dual sided nature of the mailer construction as will be now described.

Figure 2:
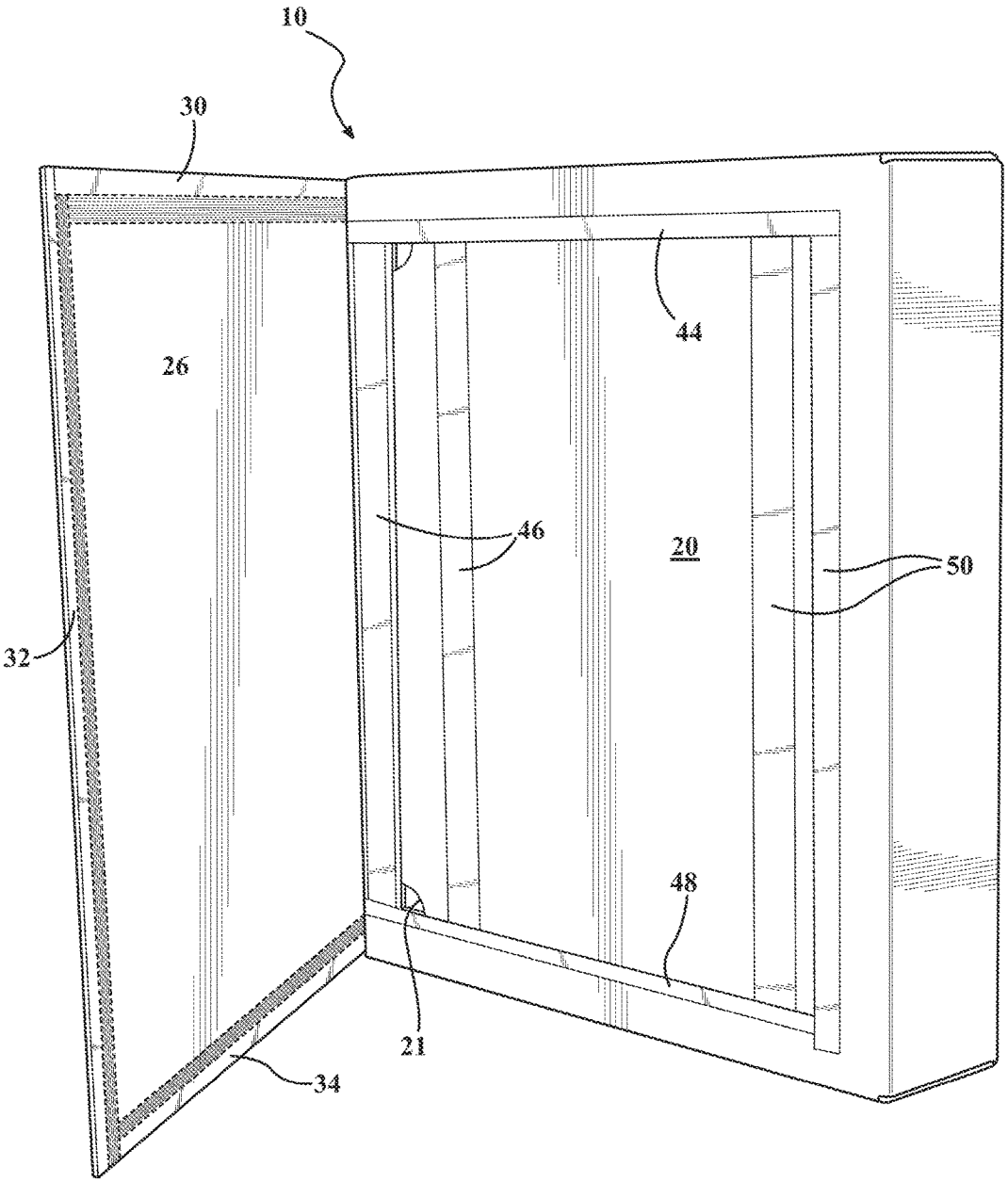
FIGS. 2 and 3 each illustrate a partially open position of a first side of the mailer and illustrating offset first and second tamper evident sealing adhesives associated with each of a first outer pivoting lid and an underlying removable panel revealing a first facing side of the interior and tamper evident accessible compartment.
Figure 6:
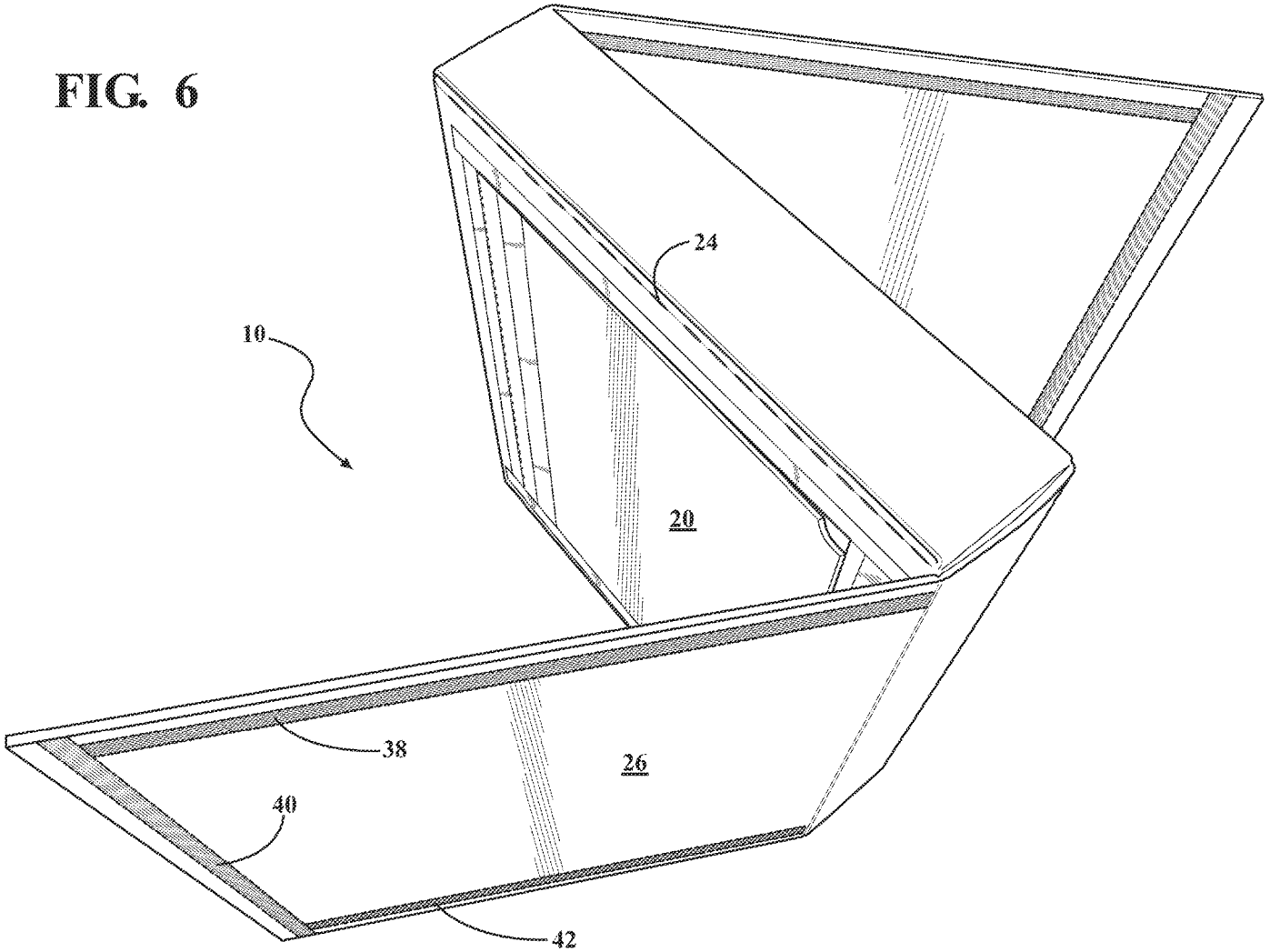
FIGS. 6-7 are first and second rotated and downward looking perspectives of the document mailer of the present invention and which respectively illustrate first and second opposite disposed tamper evident protocols for accessing the interior compartment, each of which exhibiting the offset and perimeter extending sets of tamper evident peel away strip adhesives affixed respectively to the inside surfaces of the hinged outer lids and the inner breakaway panel supporting surfaces for accessing the inner compartment for providing each of first leg mailer and second return leg mailer capability in tamper evident fashion.
Figure 7:
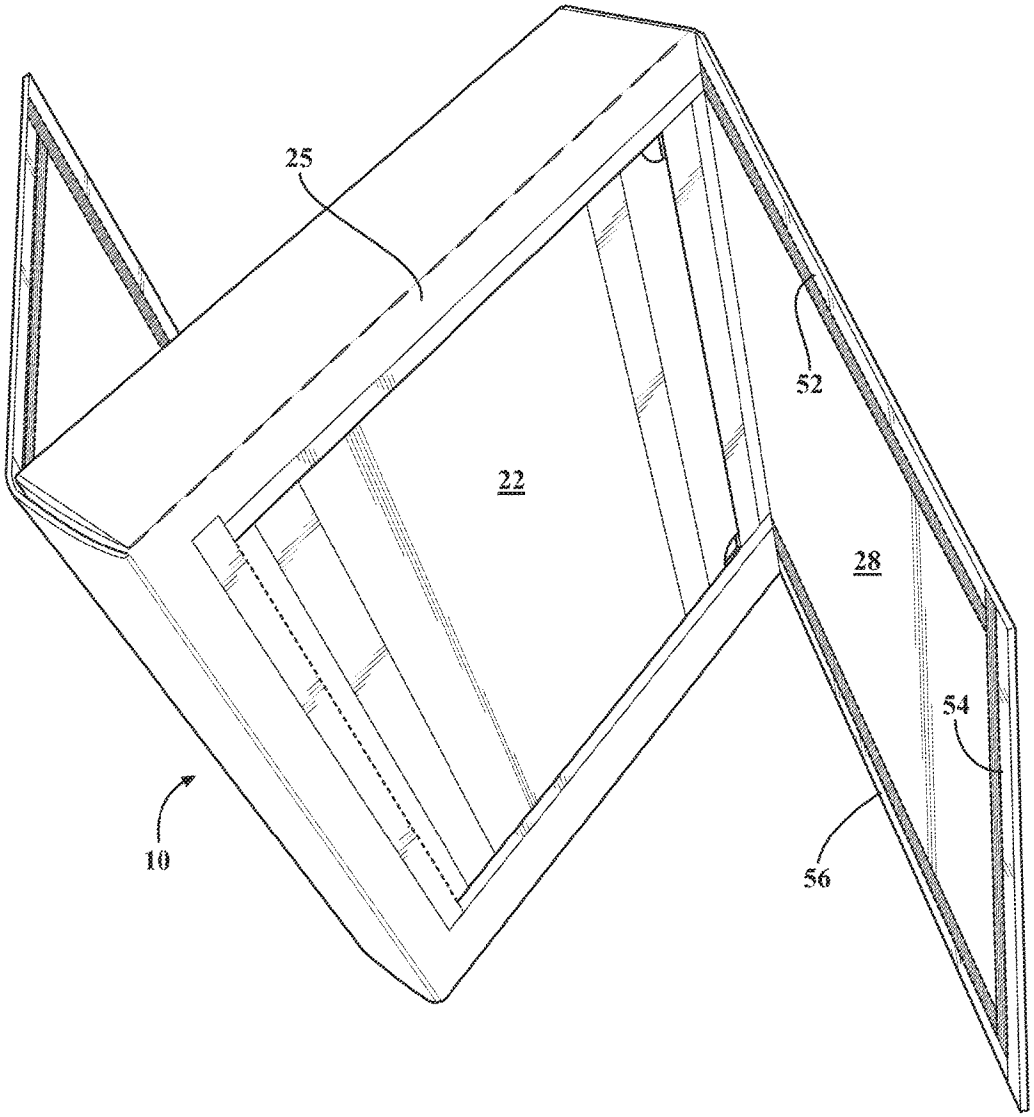

Referring to FIGS. 6-7, illustrated are first and second rotated and downward looking perspectives of the document mailer 10 of the present invention, and which respectively illustrate the first 12 and second 14 opposite side access conditions for accessing the interior compartment defined within the body, such as which is accessible via breakaway (or removal) panels 20 and 22 configured upon opposite facing outer surfaces (at 24 and 25 in FIGS. 6-7, respectively) for accessing the body interior (FIG. 2 further shows a recessed tab corner 21 for permitting insertion of a finger-hold in order to break-away and remove the associated panel 20 from the weakened perimeter extending locations securing the same to the adjoining surface of the body). Without limitation, the forensic mailer body can be constructed of any durable material such as a rigid paperboard and, in instances of depositing evidentiary items including organic matter of any type, can also integrate a Kraft paper lining or the like. As is known, Kraft paper is paper or paperboard (cardboard) produced from chemical pulp produced in the kraft process, whereas Sack kraft paper, or just sack paper, is a porous kraft paper with high elasticity and high tear resistance, designed for packaging products with high demands for strength and durability.

Figure 1:
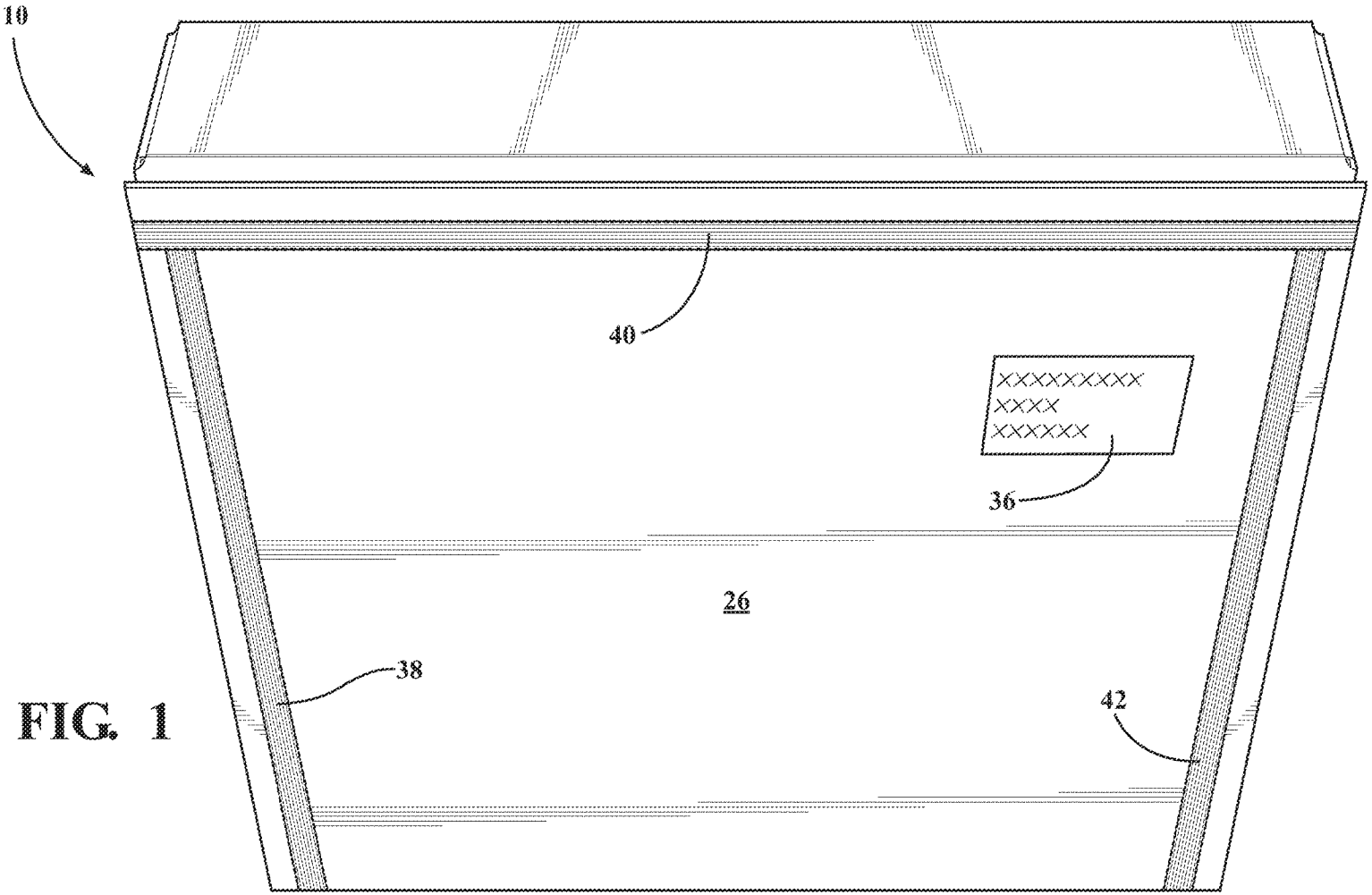
FIG. 1 is a perspective view of the document mailer of the present invention in a sealed and pre-use condition.
Figure 3:
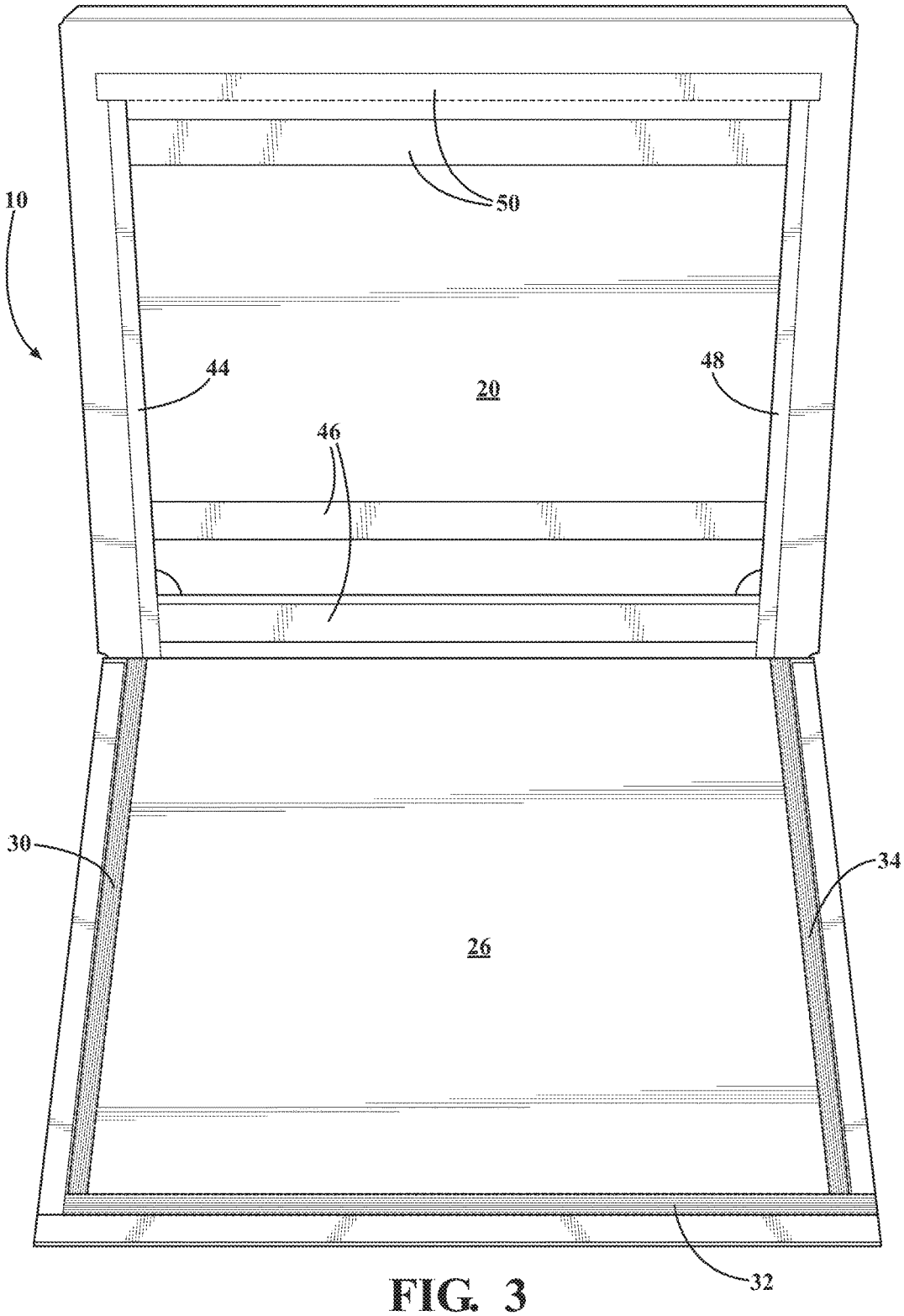

A pair of outer pivoting lids are shown and including first lid 26 for accessing breakaway panel 20 to first inner compartment access configuration 12, as well as second lid 28 for accessing breakaway panel 22 to second compartment access configuration 14. As best shown in FIGS. 1-3, an inside face of the first lid 26 exhibits a first outermost perimeter extending (three sided) arrangement of peel away adhesive revealing strips, see at 30, 32 and 34. Upon the original addressor inserting the evidentiary item 16 (FIG. 4) or other item into the compartment associated with first loading condition 12 (and following removal of the first breakaway panel 20), the outer peel strips 30, 32, and 34 are removed, the lid 26 reclosed, and the package posted or mailed with a the attachment of a first mailing label (see at 36 in FIG. 1).

Upon receipt of the mailer package by the initial addressee, a series of three tear-away strips 38, 40 and 42 (see FIGS. 1 and 6) positioned on the exterior of the sealed lid 26 are removed. The outside surface accessible tear-away strips are arranged in an inwardly spaced perimeter extending relationship relative to the inner facing and adhering tamper evident adhesives 30, 32 and 34, such that sectioning off the outer portions of the lid 26 results in detachment from the outer adhesively secured edges and access to the interior compartment in the first noted use condition or configuration 12 in which either of the documentation 18 or the evidentiary item 16 (whichever is first deposited) is retrieved.

At this point, and upon the original addressee/return addressor replacing the second leg item (again including any of an evidentiary item, document, or the like) an additional set of adhesive strips 44, 46, 48 and 50 depicted in each of FIGS. 2-3 are removed to reveal tamper evident adhesive surfaces, the spacing of which seats against the downwardly folded outer perimeter edges of the re-closed (reduced dimensioned) lid 26, factoring in the loss of material resulting from the sectioning of the prior outermost edges by the tear-away portions 30, 32 and 34. The package mailer is therein reclosed in tamper evident fashion and is mailed in a second stage using a second mailing label (similar to as shown at 36 in FIG. 1) to a second addressee. A similar pattern of peel away adhesive revealing strips, see at 44', 46', 48' and 50' is provided on the reverse face of the mailer (see FIG. 4) for likewise sealing a second access side of the mailer in similar manner as provided for the first access side.

Upon being received by the second stage/leg addressee, the mailer body 10 is inverted to its second side (e.g. FIG. 7), at which point additional tear away strips 52, 54 and 56 (shown on the inside surface of the lid 28 in FIG. 5 but understood to be accessed from the exterior exposed side) are removed, this again in order to detach the inner portion of the second lid 28 from its outer most tamper-evident sealing configuration established by previous peel away adhesive strips 58, 60 and 62. At this point, inner breakaway panel 22 is removed (or can be pre-removed) and the second stage contents of the enclosure are accessed, such as in condition 14 in FIG. 5.

Having described my invention, other and additional preferred embodiments will become apparent to those skilled in the art to which it pertains. This can include a number of different design modifications, including reconfiguration the body to include sub-compartments, such including either a hidden interior separating wall or multiple sub-divided areas which can be accessed through either breakaway panel. It is also envisioned that the forensic document mailer can be reconfigured so that only a single side is accessible/reclosable in tamper evident fashion in order to prevent surreptitious access to the items being sent by any unauthorized party.

Additional aspects of the invention include the reuse of the document mailer avoiding contamination of such as evidentiary items, and which can otherwise result from the use of separate packages between the sending and receiving parties. Yet additional features include the incorporation into the packaging of an electronic key or other digitized identification protocol (such as which can also incorporate any of a scan-able barcode or quick response (QR) code, as well as incorporating such a key or digital implantable device with any of a Bluetooth or Near Field Communication capability), such being for confirming the identity of the document mailer and its contents (such as being the same as was initially sent out) and which can be logged or documented in an electronic file to which the code or digital reading device is paired.

I claim:

1. A secure mailer, comprising:

a rigid three dimensional body having a lid hingedly attached thereto;

a surface of said body exhibiting a breakaway panel for gaining access to an interior enclosure;

a plurality peel away strips revealing adhesives supported upon an inside surface of said lid and, upon pre-depositing a first item within said enclosure, for sealing said lid against said body in tamper evident and closing fashion;

a plurality of tear-away strips located inwardly of said adhesives with respect to a perimeter edge of said body, said strips being accessible from an exterior of said lid and along three sides interconnecting with a fourth hinged side, removal of said tear-away strips causing detachment of an inner remaining area of said lid from said adhesives for re-accessing said interior enclosure; and a second plurality of peel away strips supported upon said surface of said body surrounding a perimeter defining said breakaway panel, removal of said second strips permitting tamper evident reclosing of said inner remaining rear of said lid.

2. The mailer as described in claim 1, said breakaway panel further comprising first and second panels arranged on opposite surfaces of said body, said lid further comprising first and second lids hingedly attached to said body in overlaying fashion relative to said panels.

3. The mailer as described in claim 1, further comprising said body being constructed of a rigid corrugated paperboard material.

4. The mailer as described in claim 1, said body being utilized in a first stage for secure and tamper-evident storage and transport of an item of evidence, said body subsequently being utilized in a second succeeding stage for removal of the evidence and replacement with an associated documentation for secure and tamper-evident storage and transport of the documentation.

5. A secure mailer, comprising:

a rigid three dimensional body having a lid hingedly attached thereto;

a surface of said body exhibiting a breakaway panel for gaining access to an interior enclosure;

said breakaway panel further including first and second panels arranged on opposite surfaces of said body, said lid further including first and second lids hingedly attached to said body in overlaying fashion relative to said panels;

a plurality peel away strips revealing adhesives supported upon an inside surface of each of said lids and, upon pre-depositing a first item within said enclosure, for sealing said lids against said body in tamper evident and closing fashion;

a plurality of tear-away strips located inwardly of said adhesives with respect to a perimeter edge of said body, said strips being accessible from an exterior of said lids and along three sides interconnecting with a fourth hinged side, removal of said tear-away strips causing detachment of an inner remaining area of each of said lids from said adhesives for re-accessing said interior enclosure; and said body being utilized in a first stage for secure and tamper-evident storage and transport of an item of evidence, said body subsequently being utilized in a second succeeding stage for removal of the evidence and replacement with an associated documentation for secure and tamper-evident storage and transport of the documentation.

6. The mailer as described in claim 5, further comprising a second plurality of peel away strips supported upon said surface of said body surrounding a perimeter defining said breakaway panel, removal of said second strips permitting tamper evident reclosing of said inner remaining area of said lids.

7. The mailer as described in claim 5, further comprising said body being constructed of a rigid corrugated paperboard material.

* * * * *